United States Patent [19]

Voigt et al.

[11] Patent Number: 4,555,994

[45] Date of Patent: Dec. 3, 1985

[54] BOILER-HEATING ASSEMBLY WITH OIL- AND COAL-FIRED IGNITION BURNERS

[75] Inventors: Karl Voigt, Cologne; Jürgen Kamm, Jüchen; John Norbert, Berheim, all of Fed. Rep. of Germany

[73] Assignee: Rheinisch-Westfalisches Elektrizitatswerk AG, Essen, Fed. Rep. of Germany

[21] Appl. No.: 638,225

[22] Filed: Aug. 6, 1984

Related U.S. Application Data

[63] Continuation-in-part of Ser. No. 558,997, Dec. 7, 1983, abandoned, which is a continuation-in-part of Ser. No. 418,585, Sep. 15, 1982, abandoned.

[30] Foreign Application Priority Data

Oct. 14, 1981 [DE] Fed. Rep. of Germany ..... 3140798

[51] Int. Cl.[4] ..... F22G 5/00; F22B 37/42

[52] U.S. Cl. ..... 110/261; 110/262; 110/264; 110/347; 122/479 B

[58] Field of Search ..... 122/479 B; 110/347, 110/260–265

[56] References Cited

U.S. PATENT DOCUMENTS

| | | | |
|---|---|---|---|
| 1,468,008 | 9/1923 | Dyson | 110/261 |
| 1,953,090 | 4/1934 | Vroom | 110/262 |
| 2,046,767 | 7/1936 | Campbell | 110/261 |
| 3,147,795 | 9/1964 | Livingston et al. | 110/261 |
| 3,208,502 | 9/1965 | Carlson | 110/265 |
| 3,822,654 | 7/1974 | Ghelfi | 110/260 |
| 4,132,180 | 1/1979 | Fredrick | 110/265 |
| 4,147,116 | 4/1979 | Graybill | 110/347 |
| 4,206,712 | 6/1980 | Vatsky | 11 0/261 |
| 4,304,196 | 12/1981 | Chadshay et al. | 122/479 B |
| 4,326,702 | 4/1982 | Oueseau et al. | 110/264 |
| 4,333,405 | 6/1982 | Michelfelder et al. | 110/347 |
| 4,377,134 | 3/1983 | Frey | 122/479 B |
| 4,422,389 | 12/1983 | Schroder | 110/347 |
| 4,425,855 | 1/1984 | Chadshay | 110/347 |
| 4,434,747 | 3/1984 | Chadshay | 110/347 |
| 4,438,709 | 3/1984 | Borio et al. | 110/347 |
| 4,457,241 | 7/1984 | Itse et al. | 110/347 |
| 4,466,363 | 8/1984 | Leikert et al. | 110/347 |

*Primary Examiner*—Henry C. Yuen

*Attorney, Agent, or Firm*—Karl F. Ross; Herbert Dubno

[57] ABSTRACT

A boiler-heating assembly of a power plant has a fire chamber bounded by four vertical walls each supporting two main burners and two associated ignition burners. Each ignition burner has a cylindrical open-ended chamber with a central pipe terminating in an oil nozzle, a double-walled nozzle tube whose interspace optionally carries a mixture of air with brown-coal dust or oil set in rotation by a tangential feed, and a blower driving air axially through the chamber in an inner and an outer air stream separated by the double-walled nozzle. An annular baffle on the oil nozzle has a solid frustoconical rear surface deflecting the inner air stream radially outward across the air/fuel mixture exiting from the interspace and into contact with the outer air stream, both air streams corotating with that mixture.

1 Claim, 4 Drawing Figures

BOILER-HEATING ASSEMBLY WITH OIL- AND COAL-FIRED IGNITION BURNERS

CROSS-REFERENCE TO RELATED APPLICATIONS

This is a continuation-in-part of our copending application Ser. No. 558,997 filed Dec. 7, 1983 as a continuation of application Ser. No. 418,585, filed Sept. 15, 1982, and now both abandoned.

FIELD OF THE INVENTION

Our present invention relates to an ignition burner associated with a main burner in an assembly of such burners serving to heat a power-generating boiler.

BACKGROUND OF THE INVENTION

Burners of the type here considered generally have a central pipe through which oil (or sometimes gas) is fed to a nozzle where it is ignited by electronic means such as a spark plug. This pipe is coaxially surrounded by several tubes forming channels for the passage of air and fuel which intermix in the region of the nozzle so as to be fired by its flame. The air flow may be set in rotation by passing through a twist-blade ring or impeller, e.g. as taught in U.S. Pat. No. 4,333,405, for a thorough intermingling with the fluid which is separately conveyed to the nozzle area. While this fluid may also be oil, its high cost and occasional scarcity are conducive to the use of cheaper combustibles such as coal dust; this is also described in the above-identified U.S. patent.

Hard-coal or anthracite powder has been used, but more commonly brown-coal nozzles are employed in areas where this cheap fuel is readily available. Usually such coal nozzles are wholly separate from the oil nozzles which must be employed to maintain proper combustion. In any case it is normally considered impossible to use better than a 1:1 or 1:2 mixture by mass of coal to air, that is the nozzles cannot use less than 1 kg of air to fluidize and effectively burn more than 1 kg or 2 kg of coal so that a high proportion of expensive oil must be used even when conditions permit coal burning.

A brown-coal fuel, known as TBK 10, is a by-product of the briquetting of brown coal or lignite. It has a particle size with at least 43% by weight of 90-micron and 16% by weight of 200-micron particles, and a heat value of 21.4 MJ/kg. In spite of the attractiveness of this fuel, it has not been successfully used in a power-plant burner of the type discussed above.

OBJECT OF THE INVENTION

It is therefore the object of our present invention to provide an improved ignition burner usable in a burner assembly of a large-scale power-plant boiler.

SUMMARY OF THE INVENTION

An ignition burner according to our invention, associated with a main burner in an assembly heating a power-generating boiler of a power plant or the like, comprising a burner housing which defines a generally cylindrical chamber with a peripheral wall centered on an axis and with wide-open upstream and downstream ends. An axial air flow, generated by blower means ahead of the chamber, passes therethrough from its upstream end to its downstream end around an axially disposed igniter pipe terminating in an oil nozzle in the vicinity of the downstream chamber end. Fuel oil is fed by first supply means through the igniter pipe to the oil nozzle to form an oil spray emitted from that nozzle. A tubular, generally cylindrical and double-walled powder nozzle is spacedly centered on the igniter pipe ahead of its oil nozzle so as to divide the axial flow into an outer and an inner stream, the walls of the powder nozzle defining an interspace with an annular outlet open toward the downstream end of the chamber. The oil nozzle carries, downstream of the powder-nozzle outlet, a stationary annular baffle with a frustoconical solid rear surface projecting into the path of the inner air stream, the outer diameter of this rear surface being close to the inner diameter of the powder nozzle for deflecting the inner air stream radially outward into the path of an annular stream of a mixture of powdered coal and air which is fed by second supply means, preferably including a source of brown coal or lignite, tangentially into the interspace at an entrance manifold closed to the outside whereby that annular stream is set in rotation. This rotation is maintained during passage of the mixture through the interspace of the powder nozzle and emission by its outlet so as to insure a thorough intermingling of that mixture with the additional air of the inner stream as the latter crosses the path of the mixture on being outwardly deflected by the annular baffle. The deflected air-enriched mixture then meets the outer air stream which, along with the inner air stream, may have been set in codirectional rotation by the generaing blower means.

Advantageously, pursuant to another feature of our invention, the inner surface of the outer wall of the powder nozzle is outwardly flared at the outlet so as to cause a certain divergence of the annular mixture flow as it meets the outwardly deflected inner air stream.

Such a burner can be simultaneously oil- and coal-fired but could also be only oil-fired at times. The oil nozzle and its annular baffle, when coal cannot be burned, will in no way interfere with the combustion of oil fed instead through the interspace of the double-walled nozzle.

BRIEF DESCRIPTION OF THE DRAWING

The above and other features of our invention will become more readily apparent from the following, reference being made to the accompanying drawing in which.

SPECIFIC DESCRIPTION

Figure 4:
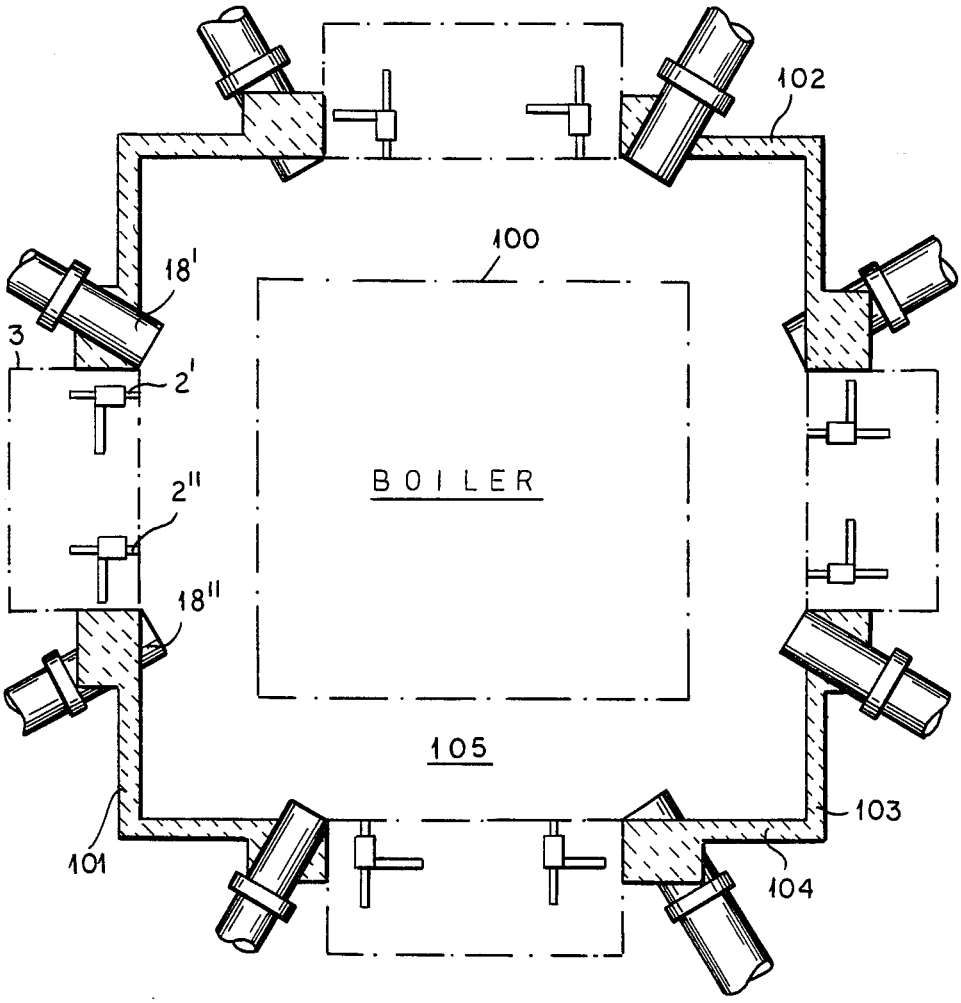
FIG. 4 is a plan view of a boiler chamber for a power plant equipped with an array of main burners and associated ignition burners as shown in FIG. 1.

Reference will first be made to FIG. 4 showing, somewhat schematicaly, a boiler 100 of an otherwise nonillustrated power plant disposed in a heating space or fire chamber 105 which is bounded by four mainly ceramic vertical walls 101–104. Each of these walls is centrally penetrated by a burner housing 3, more fully illustrated in FIG. 1, disposed between two main burners 18' and 18'' which are trained upon the boiler 100 at an upper and at a lowr level, respectively. Main burners 18' and 18'' are associated with respective ignition burners 2' and 2'', disposed in housing 3, whose construction will be described in detail hereinafter. The main burners, illustrated only in part, are fueled with comminuted brown coal or lignite. Advantageously, each housing 3 includes a common air supply and a common fuel supply for the ignition burners 2' and 2'' juxtaposed therein. The axis of each main burner intersects that of the associated ignition burner.

The horizontal cross section of heating space 105 need not be square, as shown, but could be generally rectangular. Also, the number of main burners and ignition burners carried on each wall 101–104 could be varied.

Figure 1:
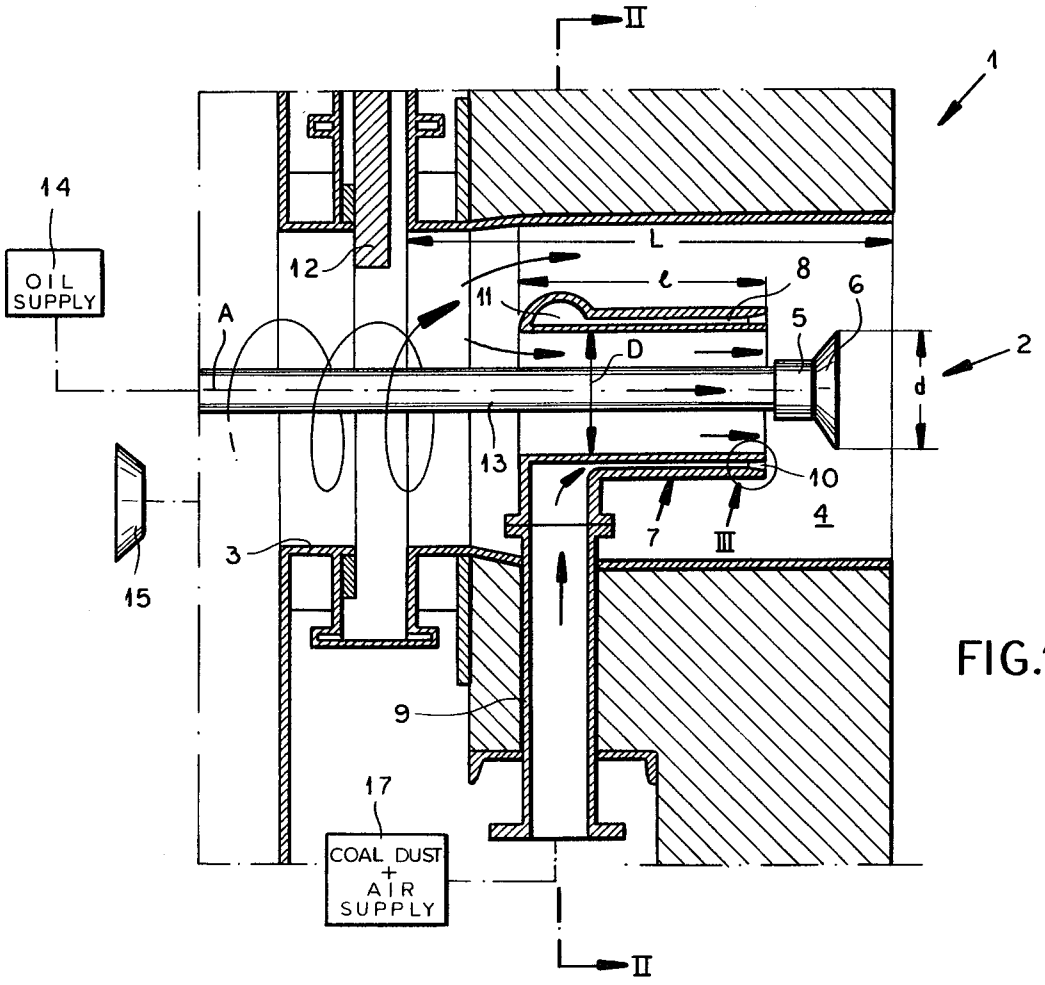
FIG. 1 is partly schematic axial section through the burner according to this invention.
Figure 2:
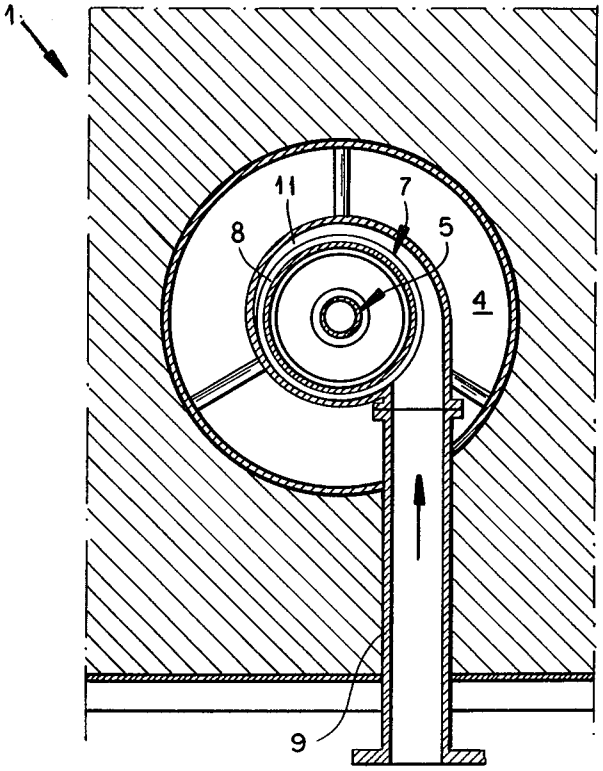
FIG. 2 is a section taken along the line II—II of FIG. 1.

As seen in FIGS. 1 and 2, the housing 3 of a representative ignition burner 2 forms a peripheral wall of a horizontally open cylindrical chamber 4 with wide-open upstream and downstream ends centered on an axis A. An oil nozzle 5 terminating in an air-deflecting annular baffle 6 is carried at the downstream end of an ignition pipe 13 that extends along the axis A out of the housing 3 and is connected to an oil supply shown schematically at 14. A blower 15 feeds air to the left-hand upstream end of the chamber 4 so that this air flows axially, and with a rotation imparted to it by the blower, to the right-hand downstream end of that chamber. A conventional shutter 12 can close off the upstream end of chamber 4.

Figure 3:
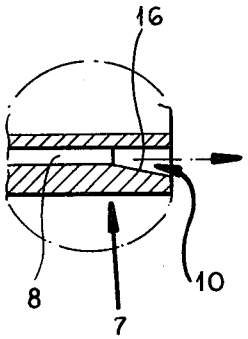
FIG. 3 is a large-scale view of the detail indicated at III in FIG. 1.

A nozzle tube 7 is coaxially and spacedly centered on pipe 13 in the chamber 4 slightly upstream of the oil nozzle 5. This tube 7, dividing the interior of chamber 4 into an outer and an inner air channel, is double-walled so that it forms a cylindrical interspace 8 that opens axially downstream at an outlet 10 more clearly seen in FIG. 3. The inner surface of the outer wall of the tube 7 is outwardly flared at 16. The opposite end of space 8 opens into a spiral-shaped, forwardly closed manifold 11 that is fed a mixture of coal dust and air from a supply 17 through a supply pipe 9 supporting the tube 7 in chamber 4. The suspension of coal dust and air is fed tangentially into the rear end of interspace 8 so that it issues corotatingly with the outer air stream from the outlet 10.

The tube 7 has an axial length l ranging between one-half and three-fourths the length L of the chamber 4, preferably equaling about two-thirds thereof. This tube, which acts as a flow smoother, directs an inner air flow onto the frustoconical rear surface of baffle 6 deflecting that flow outward past outlet 10. The inner diameter D of tube 7 is but slightly greater than the outside diameter d of the baffle 6. This allows the nozzle 5 to be changed from a standard ignition nozzle to a pilot or lance-type nozzle, depending on the chosen style of operation.

The igniter (not shown) of nozzle 5, shielded by baffle 6 from the air/fuel flow emitted by interspace 8, operates entirely in air, as does the pilot flame kindled thereby. This pilot flame is therefore unaffected by a possible changeover from coal dust to oil or vice versa.

Existing ignition burners of exclusively oil-fired type can be readily retrofitted with elements 6, 7 in order to permit such an optional changeover.

In use, fine TBK 10 brown-coal dust is mixed with air at a ratio between 4:1 and 8:1 by mass. Oil is fed in to produce about $1/19^{th}$ as much heat as the coal dust. In fact the rated capacity of the nozzle 5 may account for not more than about 5% of the maximum heat output of the burner 2. Thus the oil will serve only to keep the coal dust burning.

We claim:

1. In a plant having a power-generating boiler heated by at least one main burner associated with an ignition burner, the improvement wherein said ignition burner comprises:

a burner housing defining a generally cylindrical chamber with a peripheral wall centered on an axis and with wide-open upstream and downstream ends;

blower means for generating an axial air flow passing through said chamber from the upstream end to the downstream end thereof;

an axially disposed igniter pipe in said chamber terminating in an oil nozzle in the vicinity of said downstream end;

first supply means for feeding fuel oil via said igniter pipe to the oil nozzle with formation of an oil spray emitted therefrom;

a tubular, generally cylindrical and double-walled powder nozzle spacedly centered on said igniter pipe ahead of the oil nozzle, said powder nozzle dividing said axial air flow into an outer and an inner air stream, the walls of said powder nozzle defining an interspace with an annular outlet open toward said downstream end, the oil nozzle carrying downstream of said outlet a stationary annular baffle with a solid frustoconical rear surface projecting into the path of said inner air stream;

second supply means including a source of powdered lignite for feeding a mixture of powdered coal and air tangentially into said interspace at an entrance manifold closed to the outside and for generating a rotating annular stream of said mixture emitted by said outlet, said annular baffle having an outer diameter close to the inner diameter of said powder nozzle for deflecting said inner air stream radially outward into the path of said annular stream, said powder nozzle having an outer wall with an outwardly flared inner surface at said outlet and an axial length which is substantially two-thirds that of said chamber, said oil nozzle being retractable together with said annular baffle through said powder nozzle; and shutter means disposed ahead of said powder nozzle at the upstream end of said chamber and operable to block the air flow through said chamber, said oil nozzle having an oil-burning capacity accounting for a maximum of about 5% of the heat output of said ignition burner, said boiler being disposed in a space bounded by four vertical walls, said main burner and said ignition burner being part of an assembly of burners duplicated on each of said vertical walls, each of said vertical walls being provided with a pair of ignition burners and with two associated main burners respectively disposed at a higher and at a lower level.

* * * * *